United States Patent [19]

Miller

[11] Patent Number: 4,614,849

[45] Date of Patent: Sep. 30, 1986

[54] ELECTRICAL PRESSURE SWITCH

[75] Inventor: Ellsworth S. Miller, Mt. Clemens, Mich.

[73] Assignee: Lectron Products, Inc., Rochester, Mich.

[21] Appl. No.: 724,818

[22] Filed: Apr. 18, 1985

[51] Int. Cl.[4] ..... H01H 35/34

[52] U.S. Cl. ..... 200/81 R; 200/82 R; 200/277; 200/302.1

[58] Field of Search ..... 200/81 R, 82 R, 83 J, 200/243, 275, 277, 284, 302; 307/118; 340/603, 614, 626, 52 C; 73/714, 745

[56] References Cited

U.S. PATENT DOCUMENTS

| | | | |
|---|---|---|---|
| 3,286,058 | 11/1966 | Perkats | 200/82 R |
| 3,939,316 | 2/1976 | Stropkay | 200/83 J |
| 4,007,343 | 2/1977 | Alten | 200/81 R |
| 4,219,710 | 8/1980 | Booth | 200/81 R |
| 4,300,601 | 11/1981 | Steinberg | 200/81 R |
| 4,565,907 | 1/1986 | Takahashi | 200/19 DR |

OTHER PUBLICATIONS

Ford Motor Company drawing No. XP-157930, for Switch Assy-Trans Pressure, 8/13/84.

*Primary Examiner*—G. P. Tolin

*Attorney, Agent, or Firm*—Harness, Dickey & Pierce

[57] ABSTRACT

An electrical pressure switch that can be readily adapted for either normally open or normally closed operation and that has opposed annular seats, a movable contact and ball valve movable between and individually engageable with the seats, and an O-ring uniquely associated with the ball valve and a related sealing surface in seated, unseated and all intermediate positions of the valve to maintain an effective seal at all times against fluid pressure to which the switch is connected.

23 Claims, 7 Drawing Figures

ELECTRICAL PRESSURE SWITCH

BACKGROUND OF THE INVENTION

Pressure switches conventionally respond to a predetermined fluid pressure or a variation in the pressure to open or close a circuit between fixed spaced electrical contacts or terminals. In these conventional switches, a movable contact usually carried by a flexible diaphragm moves between open and closed positions in response to the fluid pressure to make or break the circuit.

SUMMARY OF THE INVENTION

The present invention provides a modified construction that eliminates the diaphragm and the attendant operational problems caused by the diaphragm mounting for the movable contact. More particularly, the present invention utilizes a ball valve as the movable contact and a unique combination and association thereof with an O-ring seal. This novel association and relationship of parts is more efficient in use than the diaphragm mounting previously used, there is less chance of pressure leaks in the switch, and it is significantly less expensive to manufacture.

DESCRIPTION OF THE PREFERRED EMBODIMENTS

Figure 3:
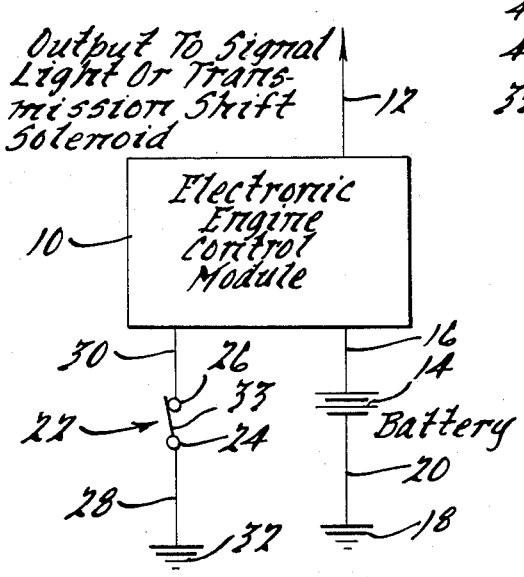
FIG. 3. PRIOR ART
FIG. 3 is a diagrammatic view showing the pressure switch of this invention in a typical environment.

The pressure switch of this invention can be used wherever a switch of this type has utility, but it is primarily adapted and pre-eminently suited for use in automatic transmission for automotive vehicles. Pressure switches are conventionally used in automatic transmissions in a manner well known in the art, as illustrated diagrammatically in FIG. 3. Transmission systems normally include an electronic engine control module 10 having an output 12 which is electrically connected to a signal light (not shown) or to the transmission shift solenoid (also not shown). Power for the electronic engine control module 10 is supplied by a battery 14 which is connected at one side to the control module 10, as indicated at 16, and at the other side thereof to ground 18, as indicated at 20. A pressure switch 22, such as the one embodying the present invention, for example, has spaced terminals 24 and 26 that are electrically insulated from each other and connected as at 28 and 30 to ground 32 and to the control module 10, as shown in the drawing. A movable contact designated generally at 33 is movable between open and closed positions in response to predetermined pressures or variations thereof to which the switch is subjected and to which it responds to interconnect the terminals 24 and 26 so as to permit current to flow through the switch from the control module 10 to ground at 32 or to electrically isolate the terminals from each other as will be well understood by those skilled in the art. In FIG. 3, the pressure switch 22 is shown in a closed position.

Figure 1:
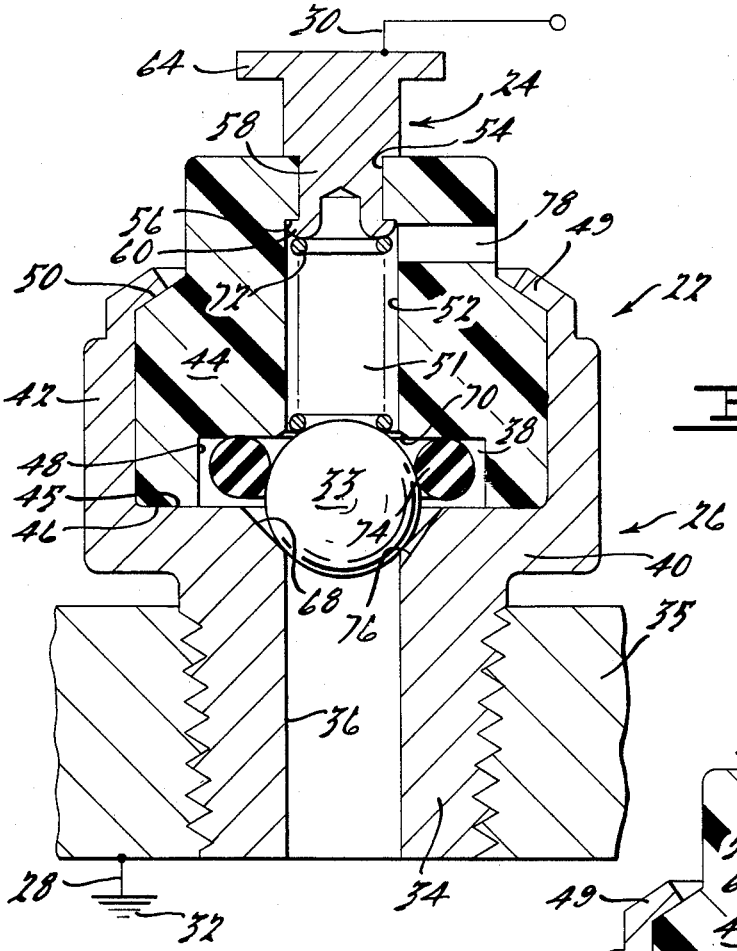
FIG. 1 is a longitudinal sectional view of a normally closed pressure switch embodying the instant invention showing the switch in the closed position.
Figure 2:
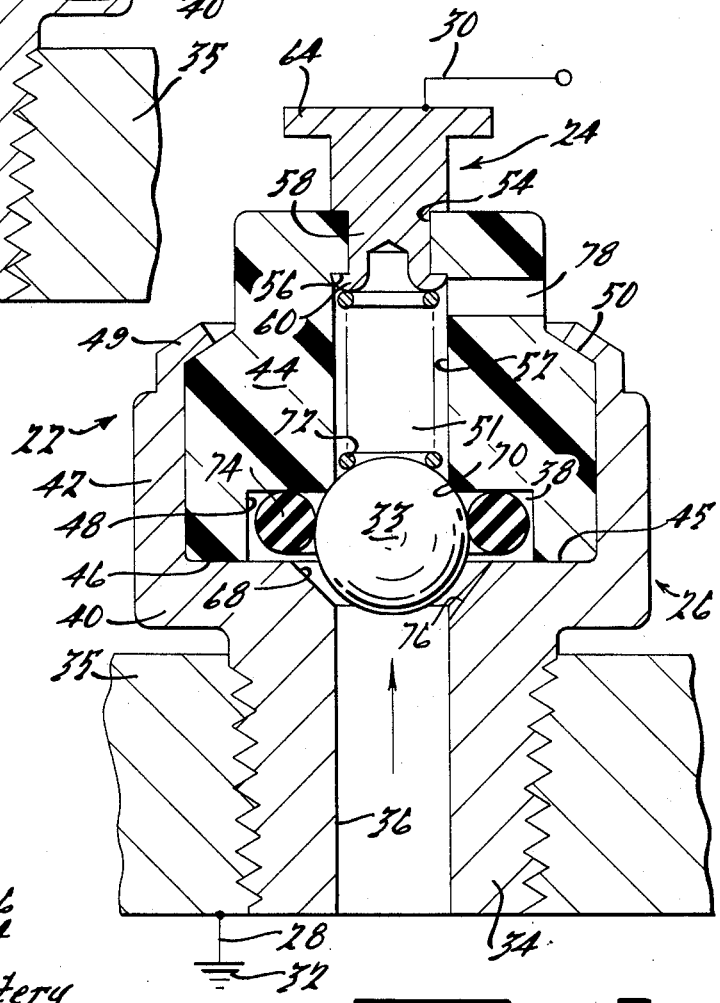
FIG. 2 is a longitudinal sectional view similar to FIG. 1 but showing the switch in the open position.

For a detailed description of a normally closed pressure switch embodying this invention, reference is first had to FIGS. 1 and 2 that graphically show the two fixed electrical contacts or terminals 24 and 26 referred to in the description of FIG. 3. In use, the switch 22 is mounted inside the transmission; and the bottom terminal 26, as the switch is shown in the drawing, has a depending, externally threaded coupling portion 34 which is adapted to be screwed into an electrically grounded aluminum housing 35 inside the transmission where a port 36 opening through the end of the coupling is in communication with fluid under pressure in the housing. This fluid enters a central chamber 38 in the switch through the port 36.

As shown in the drawing, the coupling portion 34 terminates at its upper end in an outwardly extending radial flange 40 the periphery of which is integrally joined to an upstanding annular wall 42 that surrounds and snugly fits a cover 44 of a suitable electrically insulative compressive and resilient material such as Nylon, or the like. As shown in the drawing, the bottom 46 of the cover 44 seats on the top surface 45 of the radial flange 40; and a recess 48 formed centrally in and opening downwardly through the bottom 46 of the cover 44 cooperates with the top surface 45 of the flange 40 to form the central chamber 38. The latter is in direct communication at all times with the port 36 and fluid pressure in the transmission housing 35.

The cover 44 projects above the lower terminal 26; and the upper marginal edge portion 49 of the surrounding wall 42 is spun over or staked against the cover 44 under sufficient pressure so that it presses downwardly against an upwardly tapered shoulder 50 formed on the cover 44 and holds the latter pressed solidly against and in sealing engagement with the top surface 45 of the flange 40.

Extending centrally through the cover 44 is an opening 51 which has a relatively large diameter lower portion 52 and a relatively small diameter upper portion 54 that intersect at a radially extending annular shoulder 56. The upper terminal 24 is a conventional rivet-type having an end shank 58 that extends through the small diameter upper portion 54 of the opening 51; and the lower end portion 60 of the shank is peened over the radial shoulder 56 of the cover 44 to hold the terminal 24 attached securely to the cover.

A radial flange 64 at the top of the terminal 24 is adapted to slidably join and to interconnect with a conventional channel-shaped electrical conductor (not shown) which is shown at 30 diagrammatically in the drawings. As indicated previously, when the pressure switch is adapted and intended for use with an automotive transmission, the conductor 30 extends from the terminal 24 and is connected to the electronic engine control module 10.

At its lower end, the relatively large diameter portion 52 of the opening 51 opens into the chamber 38. The movable contact 33, which is in the shape of a ball or sphere as shown in the drawings, is disposed in the chamber 38 and is movable between and independently engageable with opposed, axially spaced seats 68 and 70 at the top of the port 36 and the bottom of the opening 51, respectively. A helical spring 72 confined between the upper terminal 24 and the movable contact 33 holds the latter normally in engagement with the seat 68. An O-ring 74 also in the chamber 38 surrounds the ball contact 33 and simultaneously engages the top of the recess 48 and the ball contact above its center. Thus, the helical spring 72 and the O-ring 74 mutually cooperate to hold the movable ball contact 33 against the seat 68. The O-ring 74 is dimensioned to be normally tensioned so that it establishes and maintains an effective pressure seal against the contact 33 and the top surface of the chamber 38 around upper seat 70. A plurality of coined grooves 76 formed in the lower seat 68 and preferably disposed in generally equi-spaced relation around the circumference of the latter provide communication between the port 36 and the chamber 38 at all times so that fluid pressure in the transmission housing 35 is transmitted to the chamber 38 through the grooves 76 where the fluid exerts pressure against the O-ring 74 to augment the inherent resiliency of the O-ring in maintaining an effective sealing engagement with the contact 33 and the top surface of the chamber 38.

The interior of the transmission above the housing 35 is at or substantially at atmospheric pressure; and the opening 51 communicates therewith through a side relief port or vent 78. Thus, the pressure differential across the ball contact 33 is always equal to the pressure differential between the transmission pressure and atmospheric pressure. From the foregoing, it will be readily apparent that, in use, the pressure switch hereinabove described functions as a normally closed switch and that it responds to variations in pressure in the port 36 to move between a normally closed position shown in FIG. 1 and the open position shown in FIG. 2. When the fluid pressure in the port 36 is equal to or less than a predetermined minimum pressure, it exerts insufficient pressure against the movable ball contact 33 to overcome the combined resistances of the spring 72 and the O-ring 74. However, when the fluid pressure in the port 36 exceeds a predetermined maximum pressure that is sufficient to overcome the combined resistance of the spring 72 and the O-ring 74, the ball contact 33 will lift off the seat 68 and move into engagement with the upper seat 70, as shown in FIG. 2. In practice, the predetermined minimum pressure may be any pressure between atmospheric pressure or less or a pressure that may be only a few degrees less than the predetermined maximum pressure. Thus, as long as the fluid pressure in the port 36 is less than the predetermined maximum pressure, the two terminals 24 and 26 are electrically interconnected through the spring 72 and the ball contact 33 to complete an electrical circuit through the switch. On the other hand, whenever the fluid pressure in the port 36 is greater than the predetermined maximum pressure, it will lift the movable ball contact 33 off of the lower seat 68 and into engagement with the upper seat 70 to break the electrical connection between the two terminals 24 and 26 since, in the open position of the contact 33 last described, the two fixed contacts 24 and 26 are electrically insulated from each other by the cover 44.

Manifestly, the value of the predetermined pressure required to open the switch can be regulated by varying the strength of the spring 72. As a practical matter, this value of course can be easily regulated and controlled. In a typical transmission environment, for example, the pressure switch of this invention normally will remain in the closed position shown in FIG. 1 so long as a fluid pressure less than about 33 psi obtains in the port 36 and it will move to and remain in the open position shown in FIG. 2 when there is a fluid pressure of 35 psi or more in the port 36. Since the O-ring 74 is exposed to whatever fluid pressures is in the port 36, the fluid pressure acts effectively against the O-ring at all times, regardless of whether the contact 33 is in the open or closed position or is moving from one position to the other. Thus, the contact 33 performs a dual function of serving as a movable electrical contact and also as a ball valve to maintain an effective pressure seal in all operating conditions of the switch.

In addition to the foregoing, it is an important feature of the invention that, by reason of its particular mounting and arrangement and its correlation with the ball shaped movable contact 33, the O-ring 74 that maintains the pressure seal in the switch is subject to minimal stress in use and therefore has an exceptionally long useful life. As suggested, the O-ring engages the movable contact or ball valve 33 above its center when in the close position so as to act against the ball to urge it downwardly against the seat 68. In the size of pressure switch normally used in an automobile transmission the O-ring 74 expands about 0.008" as the contact 33 moves from the closed position to the open position. However, if the O-ring engages the contact 33 sufficiently close to the center of the contact so that it moves past the center of the contact when the latter moves between the open and closed positions, the expansion of the O-ring is reduced to about 0.002". Thus, the stress on the O-ring is minimal under the circumstances last described and the useful life of the operating parts is correspondingly extended.

Furthermore, since it is not necessary for the movable contact or ball valve 33 to engage the lower seat 68 sufficiently closely to seal the port 36, that function is served by the O-ring 74, and it is not necessary to provide a finely furnished or special seat of plastic material or the like in order to assure an effective seal for the fluid pressure in the transmission. The latter function is served effectively by the O-ring 74 which is a standard part that is relatively inexpensive and is commercially readily available as an over-the-counter item in a wide range of sizes. All of these considerations, plus the fact that every component of the device can be manufactured relatively easily and inexpensively renders the entire assembly of parts significantly less expensive than conventional pressure switches now in use.

Figure 4:
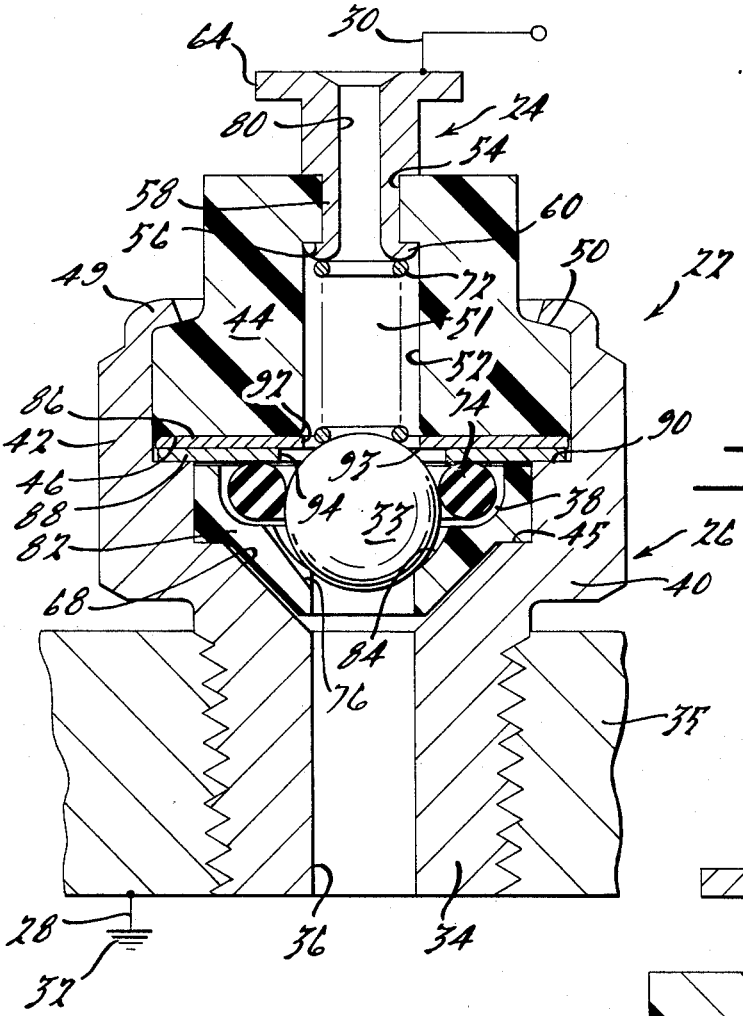
FIG. 4 is a longitudinal sectional view of a normally open pressure switch also embodying the instant invention and showing the switch in the open position.
Figure 5:
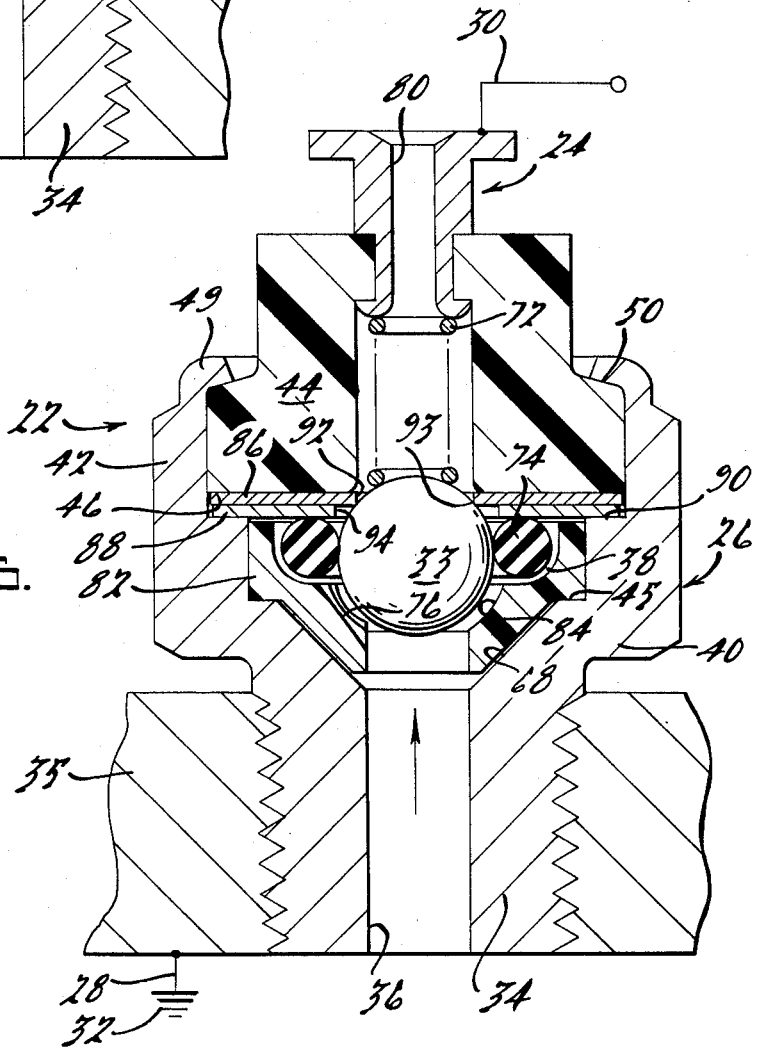
FIG. 5 is a longitudinal sectional view similar to FIG. 4 but showing the switch in the closed position.

Reference is next had to FIGS. 4 and 5 which show a modified form of normally open electrical pressure switch embodying the present invention. This normally open switch is generally similar to the normally closed switch first described; but it involves appropriate reconstruction and re-arrangement of the internal parts in order to adapt it for a normally open mode of use. Accordingly, those parts that are common to or similar in the two switches are identified by corresponding reference numbers; and only the parts that distinguish the two switches are numbered differently.

In connection with the foregoing, it will be readily apparent that the upper terminal 24 shown in FIGS. 4 and 5 is similar in all essential respects to the upper terminal 24 described in connection with the first form of the invention. The only difference is that the relief port 78 in the cover 44 of the normally closed pressure switch is replaced by a corresponding port 80 that extends axially centrally through the terminal 24. It will be readily apparent, however, that if desired a relief port in the cover 44 similar to the one previously described can be used.

Also, in the normally open switch of FIGS. 4 and 5, an annular liner 82 of a suitable electrically insulating material such as Nylon or the like is provided on the lower beveled surface 68 inside the lower terminal 26; and the liner 82 is formed with a similar correspondingly beveled, downwardly tapered seat 84 that is engaged by the movable contact or ball valve 33 which is normally urged downwardly against the seat 84 by the combined actions of the helical spring 72 and the O-ring 74 which are disposed in the normally open construction of the pressure switch in the same manner as in the first form of the invention and that mutually cooperate to hold the movable contact 33 normally down against the liner seat 84. Moreover, the seat 84 is formed with grooves 76 in the same manner and for the same purpose as the correspondingly numbered grooves in the normally closed switch.

Also, in the normally open valve, the cover 44 is shorter than in the first form of the invention and metal disk means comprising a metal washer-shaped disk 86 superimposed on a curved spring washer 88 is interposed between the bottom 46 of the cover 44 and an internal upwardly facing annular shoulder 90 provided in the lower terminal 26 above the liner 82. The disk 86 is formed with a central opening 92 and the movable contact 33 seats against the near edge 93 of the opening 92 in the upper closed position. The spring washer 88 also is formed with a central opening 94 that is sufficiently larger in diameter than the disk opening 92 so as not to interfere with movement of the movable contact 33 into and out of engagement with the near or adjacent seating edge of the washer opening 92. Manifestly, the disk 86 has a good electrical contact with the lower terminal 26 through the spring washer 88 so that, when the movable contact 33 is in the raised seated position against the disk, it also makes good electrical contact with the lower terminal 26 through the disk 86 and the spring washer 88. When the marginal edge flange 49 is spun inwardly and downwardly against the tapered shoulder 50, it also exerts pressure axially against the cover tending to hold the disk numbers 86 and 88 firmly against the shoulder 90 to provide a good electrical contact therebetween as in the form of the invention first described. However, in this second form of the invention, the downward pressure exerted by the flange 49 is or may be offset slightly by the counterpressure exerted on the disk 86 by fluid pressure in the port 36 on the ball contact 33 when the latter is in the upper closed position. However, in the disk arrangement here shown and described, the spring washer 88, which acts similarly to a conventional Bellville washer, mutually cooperates with the flange 49 to augment the downward pressure applied by the latter to assure good firm electrical contact between the two disks 86 and 88 and between the disk washer 88 and the bottom terminal 26. Also the washer 88 defines a radially extending, annular shoulder against which the O-ring 74 seats and along which it moves to accommodate movement of the contact 33 between the seats 84 and 93.

From the foregoing, it will be apparent that, when the fluid pressure in the lower terminal port 36 is below a predetermined maximum pressure, the combined action of the helical spring 72 and the O-ring 74 will overcome the fluid pressure and hold the movable contact 33 in the "down" position exactly as in the form of the invention first described. However, since in the normally open switch of FIGS. 4 and 5, the movable contact 33 seats downwardly against the liner 82 which is electrically insulated from the lower terminal 26 and is out of contact with both the metal disk 86 and the metal washer 88, the electrical circuit between the upper and lower terminals 24 and 26 is broken and the switch is in the "open" position. On the other hand, if the fluid pressure in the lower terminal port 36 exceeds the predetermined maximum pressure, it overcomes the combined resistance of the helical spring 72 and the O-ring 74 and moves the contact 33 upwardly against the metal disk 86. As soon as this happens, a contact is established between the two terminals 24 and 26 through the helical spring 72, the movable contact 33, the metal disk 86, and the metal washer 88 which rests directly on the top surface 45 of the bottom terminal flange 40. It will also be apparent that the closed circuit between the two terminals 24 and 26 will be maintained so long as the fluid pressure in the lower terminal port 26 remains above the predetermined maximum pressure. However, as soon as the fluid pressure in the port 36 drops significantly below the predetermined pressure referred to, the combined action of the helical spring 72 and the O-ring 74 overcomes the counteraction of the fluid pressure and moves the contact 33 downwardly out of engagement with the disk 86 and into engagement with the liner 82 to open the circuit between the two terminals 24 and 26.

Manifestly, the normally open switch (FIGS. 4 and 5) has all of the advantages of the normally closed switch first described. The O-ring 74 is exposed to fluid pressure from the port 36 at all times so that the pressure of the fluid is utilized to augment the inherent resilient action of the O-ring in creating and maintaining an effective seal against the fluid pressure in the switch. Similarly, the O-ring 74 serves the dual function of sealing the movable contact 33 and also of cooperating with the helical spring 72 to hold the movable contact normally in the lower position which, in this instance, is the "open" position. Also, the normally open switch shown in FIGS. 4 and 5 comprises a relatively small number of parts; and the parts are either items that are readily available "off-the-shelf" or they can be readily manufactured relatively inexpensively. Also, the particular pressure at which the fluid in the port 36 overcomes the combined action of the helical spring 72 and the O-ring 74 can be readily controlled and adjusted by varying the size and strength of the helical spring so that the pressure switch can be readily adapted to the requirements of any particular environmental situation where it is adaptable for use.

Figure 6:
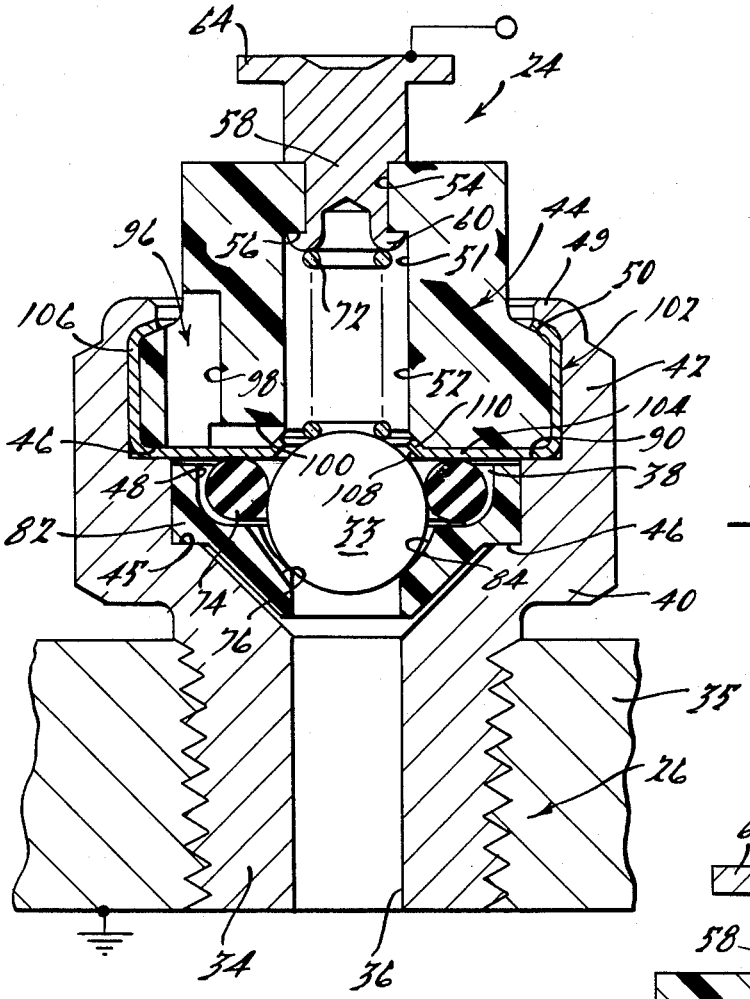
FIG. 6 is a longitudinal sectional view similar to FIG. 4 but showing a modified form of normally open switch embodying the invention and illustrating the switch in the open position.
Figure 7:
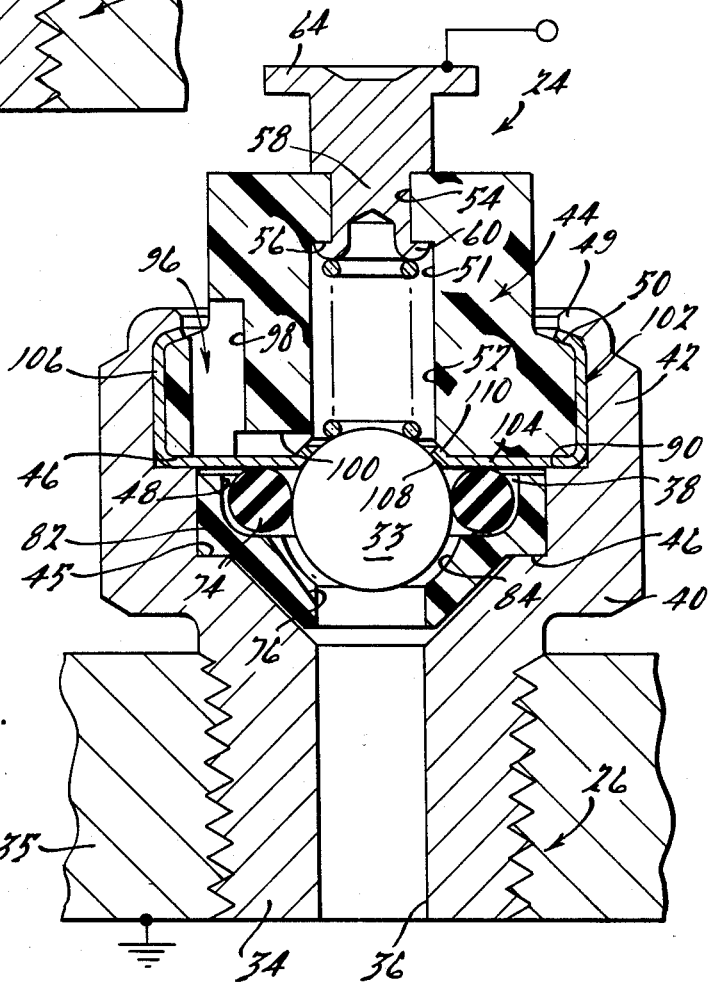
FIG. 7 is a longitudinal sectional view similar to FIG. 6 but showing the switch in the closed position.

Referring now to FIGS. 6 and 7, which illustrate a modified form of the normally open electrical pressure switch shown by FIGS. 4 and 5, it should perhaps be noted first off that in view of the similarities between the two forms of normally open switch, corresponding parts of the two switches are identified by corresponding reference numbers and only those parts that distinguish the two switches are numbered differently.

In the form of the invention shown in FIGS. 6 and 7, both the terminal 24 and the cover 44 at the top of the switch as shown in the drawing are identical to the corresponding elements in the FIGS. 4 and 5 embodiment except that the pressure relief opening 80 is omitted from the terminal and placed in the cover, as shown 96. More particularly, the pressure relief opening 96 comprises a blind ended hole 98 that extends longitudinally of the body 44 from the bottom of the cover to a point above the staked marginal portion 49 of the lower terminal 26 and a radial slot 100 in the bottom of the cover that extends radially outwardly from the central opening 52 to intersect the hole 98. In this connection, it will be observed that the blind ended hole 98 opens through the outer surface of the cover 44 at the tapered shoulder 50 to assure equalization of pressure between the chamber 52 above the ball contact 33 and the atmosphere exteriorly of the pressure switch which, as previously suggested, in the transmission environment in which the pressure switch of this invention is particularly intended to be used, is approximately equal to atmospheric pressure.

The change in location of the pressure relief opening simplifies the construction and makes it less expensive to manufacture since it eliminates a drilling operation in the upper terminal 24 which, of course, is made of metal and replaces it with the opening 96 that can be formed without additional expense in the cover 44 during the molding operation by which the cover is made. In practice, the cover 44 preferably is injection molded of Nylon or like material and, because the opening 96 is formed in and extends from the bottom 46 of the cover, the core parts that form the opening can be part of the lower die so that the opening is formed automatically when the die halves are separated.

Another significant change in the modified normally open switch construction shown in FIGS. 6 and 7 is that the two-piece metal disk means 86 and 88 shown in FIGS. 4 and 5 is replaced by a one-piece element 102. More particularly, the metal disk means 102 comprises integrally interconnected radially extending and longitudinally extending annular members 104 and 106. In practice, the element 102 is disposed in the upper portion of the lower terminal 26 with the outer marginal portion of the horizontal member 104 resting on the shoulder 90 of the terminal and the longitudinally extending member 106 fitting snugly inside the annular terminal wall 42. This arrangement makes it possible to form the upper seat 108 engaged by the ball contact 33 when in the closed position shown in FIG. 7 as an integral part of the disk means. In practice, the seat 108 is defined by an upwardly and inwardly extending lip 110 formed at the inner periphery of the radial member 104 which substantially coincides with the longitudinal annular wall of the opening 51. By reason of this construction, the seat 108 defined by the lip 110 is significantly wider than the edge surface 93 provided by the metal disk means shown in FIGS. 4 and 5, and the greater width of the seat 108 provides better support for and more effective electrical contact with the ball 33.

It is further significant that the longitudinally extending member 106 of the metal disk means 102 extends substantially the full length of the annular wall 42. By reason of this unique relationship of parts, the upper marginal edges of the member 106 and the terminal wall 42 substantially coincides, and this in turn permits the upper marginal edge of the member 106 to be staked over the tapered shoulder 50 of the cover 44 at the same time and in the same forming operation as the upper marginal edge of the wall 42. In practice, the staking operation is performed under sufficient pressure to effect substantial compression of the cover material engated thereby both radially inwardly and longitudinally downwardly. As a consequence, the counteracting resiliency of the compressed cover material maintains a constant outward and downward pressure against the metal disk means 102 to provide and maintain an effective seal between the element 102 and the terminal 26 as well as between the cover 44 and the element 102. Consequently, the modified form of the invention shown in FIGS. 6 and 7 is able to better seal the pressures in the port 36 and chamber 38. The one-piece metal disk construction and arrangement provides a less expensive construction, and it also eliminates the step at the inner peripheries of the metal disk and washer elements 86 and 88 used in the form of the invention shown in FIGS. 4 and 5. The elimination of the stepped construction in turn assures that there will be less tendency or possibility of the ball contact 33 hanging up and not closing properly against the seat 108. At the same time, the one-piece metal disk element 102 provides the radial surface against which the O-ring 74 seats and on which it moves as the ball contact 33 travels between the lower and upper seats 84 and 108. Manifestly too, to the extent that the one-piece element 102 eliminates one of the parts comprising the metal disk means embodied in the form of the invention shown in FIGS. 4 and 5 without also eliminating the function of the omitted part, it simplifies the construction and makes it less expensive to manufacture and assemble while at the same time achieving a better seal for the fluid pressure in the port 36 and the communicating chamber 38.

While it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed is:

1. In an electrical pressure switch, a pair of fixed electrical terminals;

means electrically insulating said terminals from each other;

means defining a pair of annular seats each associated with a respective one of said terminals and in opposed relation and spaced axially apart, one of said seats being of electrically conductive material and the other of said seats being of electrically insulative material;

means electrically connecting one of said seats to one of said terminals;

cover means electrically insulating the other of said seats from the other of said terminals;

port means in one of said terminals opening through the seat associated therewith and adapted to be connected to and to communicate with a source of predetermined relatively low and predetermined relatively high fluid pressure;

an electrical contact member movable between and engageable with said seats and having a portion thereof provided with an external annular surface tapered toward and facing the terminal electrically connected to one of said seats;

means defining an annular shoulder disposed radially outwardly of said electrical contact member; and a pair of resilient members engaging said contact member, one of said resilient members being of electrically conductive material and being interposed between and in engagement with said contact member and one of said terminals and providing an electrical circuit therebetween, the other of said resilient members being in the form of an O-ring in pressed sealing engagement simultaneously with said shoulder and with the tapered surface of said contact member;

said resilient members mutually cooperating to urge said contact member normally in the direction of one of said terminals and operative with a predetermined relatively low fluid pressure in said port means to hold said contact member against the seat associated with said other terminal;

said predetermined relatively high fluid pressure in said port means being operative to move said contact member toward said one terminal and against its associated seat against the combined actions of said resilient members;

whereby an electrical circuit is established between said terminals through said one resilient member and said contact member in one seated position of the latter;

whereby the electrical circuit between said terminals is broken in the other seated position of said contact member; and whereby said other resilient member maintains a constant sealing engagement simultaneously with said contact member and with said shoulder to maintain fluid pressure of the port side of said contact member in both seated positions of said contact member and during movement of said contact member from one seat to the other.

2. An electrical pressure switch as in claim 1, wherein said one resilient member is in the form of a helical spring.

3. An electrical pressure switch as in claim 1, in which said resilient members mutually cooperate with said contact member to hold the latter in engagement with said one seat (the electrically conductive) to maintain said pressure switch normally closed.

4. An electrical pressure switch as in claim 1, in which said resilient members mutually cooperate with said contact member to hold the latter in engagement with said other seat (the electrically insulative) to maintain said pressure switch normally open.

5. An electrical pressure switch as in claim 1 wherein said O-ring is mounted in a chamber disposed between said seats.

6. An electrical pressure switch as in claim 5 wherein said shoulder comprises one wall of said chamber.

7. An electrical pressure switch as in claim 1 including by-pass means for the seat associated with said other terminal, said by-pass means permitting fluid pressure in said port to bear on said O-ring to urge the latter constantly into pressed engagement with said contact member and said shoulder in all positions of said contact member.

8. An electrical pressure switch as in claim 1 wherein said contact member is in the form of a ball.

9. An electrical pressure switch as in claim 8 in which said O-ring engages said ball laterally of its center in the direction of said one terminal.

10. An electrical pressure switch as in claim 1 wherein said one seat is an integral part of said other terminal whereby said switch is normally closed, and wherein in the closed position of said contact member a circuit is established between said terminals directly through said contact and said one resilient member.

11. An electrical pressure switch as in claim 1 wherein said other terminal has a radial flange the top surface of which faces in the direction of said one terminal.

wherein said first mentioned means comprises a cover of electrically insulative material mounted on said radial flange and carrying said one terminal in axial alignment with said port means, and including fastening means on said other terminal clampingly engaging said cover and holding the same pressed solidly against and in sealing engagement with said radial flange to retain fluid pressure in said port means.

12. An electrical pressure switch as in claim 11 wherein said fastening means comprises an annular surface on said cover tapered in the direction of said one terminal, and wherein said fastening means comprises an annular wall on and extending longitudinally from said radial flange surrounding and snugly fitting said cover, the marginal edge portion of said wall overlying and pressing against the tapered annular surface of said cover to hold the latter in pressure sealing engagement with said radial flange.

13. An electrical pressure switch as in claim 11 wherein said one seat is formed around said port means and is an integral part of said other terminal, wherein said cover is provided with a recess disposed in confronting relation to said one seat and said port means and has a bottom surface defining said annular shoulder, both said movable contact and said O-ring being disposed in said recess.

14. An electrical pressure switch as in claim 1 including an annular liner of electrically insulative material surrounding said port means and defining said other seat, annular metal disk means overlaying said liner in electrical contact engagement with said other terminal and defining said one seat (electrically conductive) and said annular shoulder, said movable contact and said O-ring being interposed between said liner and said metal disk means.

15. An electrical pressure switch as in claim 14 wherein the first mentioned means in claim 1 comprises a cover of electrically insulative material, and wherein said metal disk means comprises superimposed flat and spring washer elements having central openings at least one of which defines said one seat.

16. An electrical pressure switch as in claim 14 wherein the first mentioned means in claim 1 comprises a cover of electrically insulative material, and wherein said metal disk means comprises superimposed flat and spring washer elements, said spring washer overlaying and in engagement with a portion of said other terminal and a part thereof defining the annular shoulder referred to in claim 1, said flat washer element defining said one seat and completing an electrical circuit from said one resilient member to said other terminal through said spring washer.

17. An electrical pressure switch as in claim 14, wherein said cover means is of a compressible resilient material, and said metal disk means comprises a one-piece element having a radially extending annular member defining said one seat and said annular shoulder, and an axially extending annular member interposed between interfitting parts of said cover means and said other terminal, overlapping portions of said axially extending member and said one terminal being staked against said cover to compress the same so that the counteracting resilient action of said cover against said disk means holds the latter in pressed engagement with said other terminal to seal said relatively low and relatively high fluid pressure in said port means.

18. An electrical pressure switch as in claim 17 including a radially extending annular seat in said other terminal facing oppositely to said annular shoulder and supporting said metal disk means, and wherein the staked portions of said metal disk means and said other terminal are engaged with and pressed solidly against a tapered annular surface of said cover means, whereby compression of said cover means by staked portions acts to hold said metal disk means in sealing engagement with said other terminal both at said annular seat and at the staked portion of said other terminal.

19. An electrical pressure switch as in claim 17 including a pressure relief port communicating at one end thereof with said contact at the side thereof facing said one terminal and opening at the other end thereof exteriorly of said cover intermediate said marginal edge portions and said one terminal.

20. An electrical pressure switch as in claim 17 wherein said one terminal and said one resilient member are mounted in a central chamber provided in said cover and including a pressure relief port extending between said chamber and the exterior of said cover beyond the staked portion of said other terminal and said metal disk means.

21. An electrical pressure switch as in claim 19 wherein said pressure relief port has radial and axial portions both opening through the bottom of said cover for equalized pressure in said chamber and the exterior of said switch.

22. In an electrical pressure switch adapted to be connected to and to communicate with a source of relatively high and relatively low fluid pressure, means defining a pair of opposed annular seats spaced axially apart, and an annular shoulder disposed radially outwardly from one of said seats 70;

an electrically conductive ball valve movable between and individually engageable with said seats;

an O-ring simultaneously engaged with said annular shoulder and said ball valve urging the latter against the other of said seats 68, and simultaneously sealing both said shoulder and said ball value against said fluid pressure, an electrical terminal disposed behind each of said seats and electrically insulated from each other, one of said terminals being electrically connected to and a part of one of said seats, the other seat being of electrically non-conducting material;

spring means interposed between said one terminal and said ball valve urging the latter in the same direction as said O-ring, whereby said spring means and said O-ring mutually cooperate to urge said ball valve against said other seat 68; and port means in one of said terminals opening through said other seat (68 spring seated) and adapted to be connected to and communicate with said source of fluid pressure, whereby an electrical circuit is established between said terminals through said ball valve and spring means in one seated position of the ball valve.

23. An electrical pressure switch as in claim 22 including a chamber having a wall defining said shoulder and in which said ball valve and said O-ring are mounted; and by-pass means around said other seat providing communication between said chamber and said port means and maintaining fluid pressure in said port means also on said O-ring to urge the latter against said shoulder and said ball valve at all times.

* * * * *